United States Patent [19]

Steiner et al.

[11] Patent Number: 4,555,305

[45] Date of Patent: Nov. 26, 1985

[54] APPARATUS AND METHOD FOR COOLING A BELT PRESSING UNIT IN A PAPER MACHINE

[75] Inventors: Karl Steiner, Herbrechtingen; Christian Schiel, Heidenheim; Albrecht Meinecke, Heidenheim; Josef Müllner, Heidenheim; Hans Weiss, Heidenheim, all of Fed. Rep. of Germany

[73] Assignee: J. M. Voith GmbH, Fed. Rep. of Germany

[21] Appl. No.: 592,628

[22] Filed: Mar. 23, 1984

[30] Foreign Application Priority Data

Apr. 2, 1983 [DE] Fed. Rep. of Germany ..... 3311996
May 13, 1983 [DE] Fed. Rep. of Germany ..... 3317456

[51] Int. Cl.[4] ..... D21F 3/02

[52] U.S. Cl. ..... 162/205; 162/272; 162/358; 162/361; 100/38; 100/93 RP; 100/118; 100/153

[58] Field of Search ..... 162/358, 360.1, 361, 162/205, 272, 274, 275, 279; 100/38, 43 RP, 153, 154, 118; 29/113 AD, 116 AD; 184/6.22, 6.23, 6.28, 6.4, 6.14

[56] References Cited

U.S. PATENT DOCUMENTS

| | | | |
|---|---|---|---|
| 3,116,134 | 12/1963 | May | 184/6.23 |
| 3,269,893 | 8/1966 | Rojecki | 162/358 |
| 3,586,602 | 10/1967 | Schmidt . | |
| 3,726,338 | 4/1973 | Sorenson | 29/116 AD |
| 4,272,317 | 6/1981 | Roerig . | |
| 4,287,021 | 9/1981 | Justus et al. | 162/358 |
| 4,308,096 | 12/1981 | Cronin | 162/275 |

FOREIGN PATENT DOCUMENTS

| | | | |
|---|---|---|---|
| 728430 | 2/1966 | Canada | 162/358 |
| 1172888 | 1/1982 | Canada . | |
| 1172887 | 6/1982 | Canada . | |
| 1923784 | 12/1970 | Fed. Rep. of Germany . | |
| 3030233 | 2/1982 | Fed. Rep. of Germany | 162/361 |
| 3102526 | 8/1982 | Fed. Rep. of Germany . | |
| 3126492 | 1/1983 | Fed. Rep. of Germany . | |

*Primary Examiner*—William F. Smith
*Assistant Examiner*—K. M. Hastings
*Attorney, Agent, or Firm*—Ostrolenk, Faber, Gerb & Soffen

[57] ABSTRACT

In a belt pressing unit, which preferably serves as wet press of a paper machine, an elastic tubular press belt travels around a supporting body and, together with a back roll, forms an extended press zone. Beyond the press zone along the path of the press belt, liquid is fed to the inner side of the press belt in order to cool the press belt. This liquid is permitted to travel, together with the press belt, around the supporting body. Most of the liquid is then removed from the press belt, preferably at a position in front of the press zone. The liquid may then be cooled and fed back to the press belt. In addition, liquid may also be fed to the inner side of the press belt where the press belt enters the press zone, for cooling and lubricating a pressing surface of a press shoe which presses the press belt toward the back roll. Furthermore, control circuits may be provided, one for sensing the temperature of the liquid removed from the press belt and controlling the cooling of the press belt, and another for sensing the pressing surface temperature and controlling its cooling.

37 Claims, 8 Drawing Figures

APPARATUS AND METHOD FOR COOLING A BELT PRESSING UNIT IN A PAPER MACHINE

BACKGROUND OF THE INVENTION

1. Field of the Invention

The invention relates to a belt pressing unit and to a method of guiding a stream of cooling and lubricating liquid through the inside of a belt pressing unit.

2. Description of the Prior Art

A belt pressing unit is a pressing device which is preferably used as the wet press of a paper machine and which has a so-called extended press nip or zone. This means that the press nip is formed between a normal press roll, or back roll, on the one hand, and an elastic tubular press belt on the other hand. The press belt is adapted to be pressed against the back roll by means of a pressing device, such as a press shoe. The resulting press nip is relatively long in the circumferential direction so that pressure is exerted on the web of paper over a greater length than in a conventional roll press consisting of two rolls. The web of paper passes through the press nip together with a felt dewatering belt.

The belt press unit disclosed in German Patent Application DE-OS No. 31 26 492 has a box-shaped supporting body. Except in the press zone around the press nip, the tubular press belt travels around the body at a large distance away from the body. Lubricating liquid is fed directly onto the support surface of the pressing device. The lubricating liquid which escapes from the press zone is collected in the lower region of the inner space defined by the press belt and is removed via a discharge conduit extending through the supporting body to the outside. One disadvantage of this arrangement is that the lubricating liquid fed into the press zone is greatly heated there and thus cannot cool the press belt significantly. There is a danger that the press belt will reach an impermissibly high temperature after an extended period of operation.

The belt press units disclosed in German Patent Application DE-OS No. 31 02 526 have a substantially roll-shaped supporting body. In the arrangement shown in FIG. 1, the press belt revolves through most of its path at a slight distance from the outer surface of the supporting body. In the arrangement shown in FIGS. 4 and 5, the press belt slides over the supporting body. In the latter arrangement, there is a danger that a large amount of additional frictional heat will be produced. A large number of lubricating chambers are distributed along the circumference of the outer cylindrical surface of the supporting body for feeding a lubricating liquid. This ensures that lubricating liquid is fed to the press belt at a number of successive points in each revolution. Nevertheless, due to the large amount of frictional heat produced, substantial heating of the press belt must be expected. Outside the press zone, a sliding shoe is provided in the supporting body, which shoe cooperates with a drive roll and can also be used to tighten the press belt.

In the arrangement disclosed in U.S. Pat. No. 4,287,021, the press belt passes through most of its path around the supporting body at a slight distance from the body. A device for feeding lubricating liquid is provided just before the point where the press belt enters the press zone. In this way, the travel surface of the press shoe which transmits the pressing force to the press belt is the only surface provided with lubricating liquid. This liquid is to a large extent removed from the inner surface of the press belt by a scraper after the press belt leaves the press zone. In addition, the supporting body has openings a slight distance after the press zone so that any lubricating liquid still adhering to the press belt at that point can flow back into the inside of the supporting body.

German Patent Applications DE-OS No. 31 26 492, discussed above, and DE-OS No. 19 23 784 and U.S. Pat. No. 3,269,893 disclose that the tubular press belt, together with two tensioning disks at its ends, can form an inflatable tube roll with a closed inner space which can be inflated by compressed air. Such a closed inner space is also provided in the arrangement disclosed in German Patent Application DE-OS No. 31 02 526, discussed above, but not in the arrangement disclosed in U.S. Pat. No. 4,287,021, discussed above, since in the latter arrangement the cross-section of the supporting body differs too much from a circular shape. In that arrangement, the inner space surrounded by the press belt is open to the outside at both ends. Since the danger thus arises that lubricating oil will escape and come in contact with the web of paper, for instance, the inside of the press belt has diagonally extending grooves for conveying the lubricating liquid from the ends toward the inside.

The arrangement in which the press belt defines a closed inner space has been known now for more than twelve years. A substantially higher solid content in a web of paper is obtained by draining with a wet press with an extended press nip at the press end than by draining with traditional roll presses. Therefore, a considerable amount of energy can be saved during the subsequent thermal drying of the web of paper. Nevertheless, a belt press unit as disclosed in German Patent Applications DE-OS No. 31 26 492, DE-OS No. 31 02 526 and DE-OS No. 19 23 784 and U.S. Pat. Nos. 4,287,021 and 3,269,893, discussed above, has not been actually employed in the press end of an industrial paper machine, to the best of applicant's knowledge. Only the type of arrangement disclosed in U.S. Pat. No. 4,272,317 is actually used in wet presses with extended press nips. In that arrangement, the press belt travels over several guide rolls, some of which are mounted on swing levers for tensioning the press belt. The structural expense of that arrangement is greater than that of a tubular press belt. Furthermore, the danger arises again that lubricating liquid will escape.

Numerous design requirements have prevented the use of a belt-pressing unit with tubular press belt in wet presses up to now, including the following:

1. The press belt must not twist or form wrinkles during its revolution. In other words, the points of an imaginary line extending transverse to the direction of rotation on the press belt must all move with exactly the same speed.

2. The amount of drive energy required for the rotation of the press belt should be as small as possible. This applies also to the start-up of the belt press unit; i.e., the starting torque should be as small as possible. As a rule, a separate drive is not provided for the press belt. Rather, it is carried along by the felt belt.

3. The life of the press belt and of the press shoe should be as long as possible. For this, the heat produced must be effectively removed, among other things. A tubular press belt can give off only a very small amount of heat to the surrounding air since its circumference is substantially less than the circumference of a press belt which travels over rolls, as in U.S. Pat. No. 4,272,317, discussed above.

4. The above-mentioned requirements must be met for the customary dimensions in modern paper machines, including a work width of up to 10 m and travel speeds of the order of 1000 m/min.

SUMMARY OF THE INVENTION

The primary object of the invention is to cool a press belt of a belt press unit.

One object of the present invention is to provide a method of conducting a stream of cooling and lubricating liquid through the inner space defined by the tubular press belt of a belt press unit which meets the above design requirements. The method should assure circulation of the liquid and the greatest possible cooling and lubricating effect with the smallest possible amount of energy consumed in circulating the liquid.

This and other objects are achieved by the method and belt press unit of the invention. The invention is based on the discovery that the removal of heat from the rotating press belt using the smallest possible amount of cooling liquid can be optimized by feeding most of the cooling liquid to the inner side of the press belt behind or downstream of the press zone. The cooling liquid travels with the press belt most of the way around the supporting body.

The method of the invention includes feeding a stream of cooling oil to the inner side of the tubular press belt at a main feed position near where the press belt emerges from the pressing zone. The press belt is cooled as heat is transferred from the press belt to the cooling oil while the press belt travels from the main feed position around the supporting body. Then, before the press belt again reaches the main feed position, the heated liquid is removed from the inner side of the press belt. The liquid may be cooled before being returned to again be fed to the press belt.

The belt press unit of the invention includes a supporting body having a generally cylindrical outer surface. Around this supporting body and spaced apart from its outer surface is a tubular press belt. A pressing means on the outer surface of the supporting body presses the press belt outward toward an opposing surface, as on a mating or back roll, in a pressing zone. The press belt moves with a web through the pressing zone and moves around the supporting body in a direction of travel. A feeding means including at least one feed line feeds cooling oil to the inner side of the press belt at a main feed position near the pressing zone and in the direction of travel therefrom. A removing means near the pressing zone and in a direction opposite the direction of travel from the main feed position removes the oil from the press belt after the oil has cooled the press belt between the main feed position and the removal position.

In one embodiment, the press belt defines a closed inner space into which gas is inserted under pressure for inflating the press belt. In addition, the belt press unit may include means for receiving the oil removed from the inner side of the press belt and means for maintaining the gas pressure in the enclosed inner space as the oil is received by the receiving means. Furthermore, the belt press unit may include a container in which the oil is cooled, and the container may have flow guide walls mounted in it for coalescing bubbles of gas to remove gas from the oil.

The belt press unit may include at least one guide ledge on the supporting body for supporting the press belt spaced apart from the outer surface of the supporting body. The guide surface of the guide ledge, which rests against the inner side of the press belt, may be rounded and inclined at its entrance side. In addition, the guide ledge may have passages extending through it in the direction of travel for permitting the oil to flow past it.

In one embodiment, the oil removed from the inner side of the press belt may be cooled by flowing across a cooling surface inside the supporting body. The oil may flow across the cooling surface and through a channel back to the inside of the press belt solely under the influence of gravity.

The pressing means on the supporting body may be a press shoe extending transversely to the direction of travel. The press shoe may have at least one channel defined therein through which oil may pass for cooling the press shoe. In addition, the removing means may remove oil both at a position before the press belt enters the pressing zone and at a position immediately after the press belt emerges from the pressing zone. Furthermore, the feeding means may include a second feed line for feeding cooling oil to the inner side of the press belt just before it enters the pressing zone. In addition, the temperature of the press shoe and of the press belt may be controlled by regulating the temperature of the cooling oil or by controlling the amounts of cooling oil flowing through each of the feed lines.

Other objects, features and advantages of the invention will be apparent from the following description, together with the accompanying drawings and the appended claims.

DETAILED DESCRIPTION OF THE PREFERRED EMBODIMENTS

Figure 1:
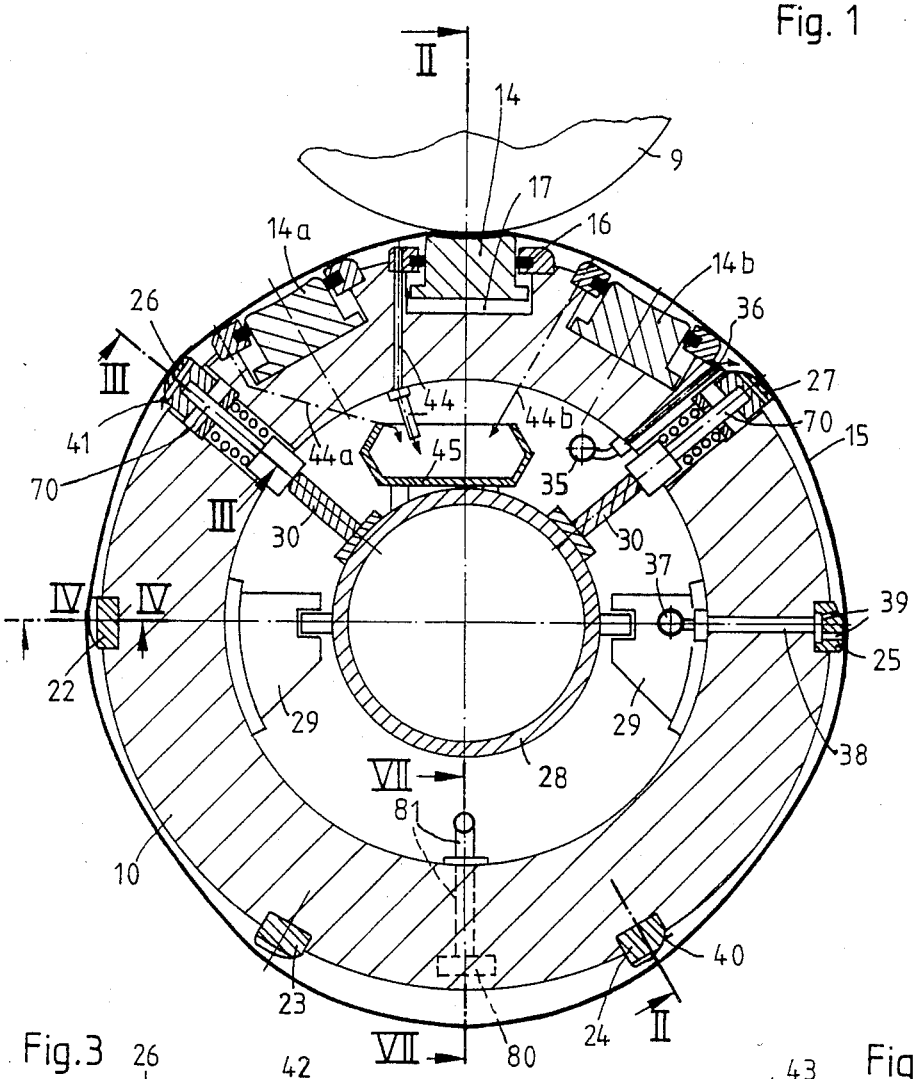
FIG. 1 is a cross-section through one embodiment of the belt press unit of the invention along the line I—I of FIG. 2.
Figure 2:
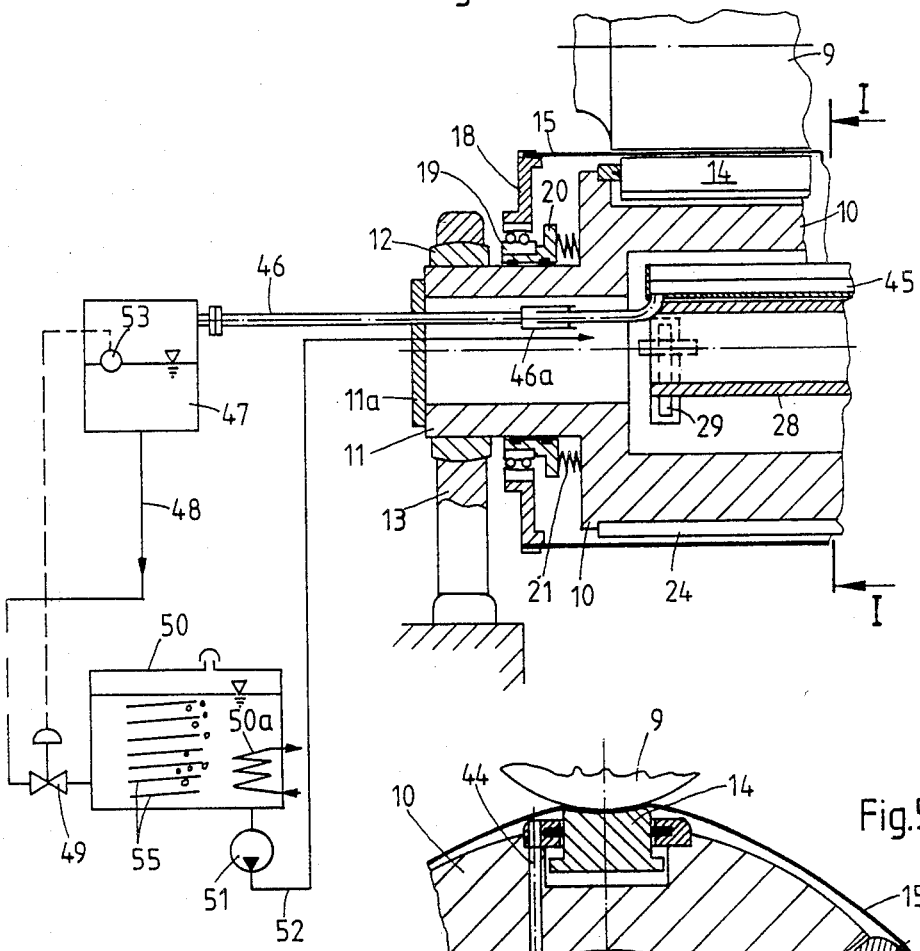
FIG. 2 is a longitudinal section through one of the two ends of the belt press unit along the line II—II of FIG. 1.

The embodiment of the belt press unit of the invention shown in FIGS. 1 and 2 includes a hollow, annular, roll-shaped supporting body 10, which has a hollow journal pin 11 at each of its ends. Each of these pins is supported in a machine frame 13 by means of a spherical bushing 12.

A press shoe 14, whose axial length dimension is approximately the same as the width of the web of paper to be treated, is mounted in a recess in the supporting body 10 facing a mating or back roll 9. The surface of the press shoe 14 which faces the back roll 9 is adapted to the shape of the surface of back roll 9. A tubular elastic press belt 15 is wrapped around the supporting body 10 and travels through the extended press nip between back roll 9 and press shoe 14. The web of paper passed through the press nip and the felt dewatering belt bearing the web of paper are not shown in the drawings.

The supporting body 10 has a packing 16 which extends annularly around the press shoe 14. As a result, the press shoe 14 can slide toward the back roll 9 in response to pressure in the recess 17 behind the shoe, so that the press shoe 14 presses the press belt 15 against the back roll 9. In this connection, the supporting body 10 can be deflected or bent due to the pressing force while the press shoe 14 and the press belt 15 apply themselves uniformly against the back roll 9.

Each of the two side ends of the press belt 15 is clamped in a rotatable disk 18. Each disk 18 is mounted by an anti-friction bearing 19 to a bearing ring 20 which is axially displaceable but non-rotatable in relation to the journal pin 11. The axial tension of press belt 15 is maintained by compression springs 21. In view of the deflection or bending of the supporting body 10, the anti-friction bearings 19 can be self-aligning bearings.

In order to reduce the starting torque of press belt 15, it is desirable to inflate the inner space surrounded by press belt 15 by means of a gas under pressure. As a result, press belt 15 travels spaced at a certain distance from supporting body 10, even though the latter is generally cylindrical and has the largest possible outside diameter. For this purpose, the outer ends of the hollow journal pins 11 are covered by caps 11*a* so that the press belt 15 can be inflated by the introduction of compressed air or any other gas under pressure. A non-oxidizing protective gas is preferably used to inflate press belt 15. The press belt cooling and lubricating liquid, which is preferably oil, will age less rapidly as a result of the action of heat if such a gas is used, increasing the life of press belt 15. The packing required for anti-friction bearings 19 and the means for feeding compressed air are not shown in the drawings.

FIG. 1 shows two additional press shoes 14*a* and 14*b*, one arranged at either side of the press shoe 14 in the circumferential direction. These additional press shoes can be placed in use as spare press shoes by rotating the supporting body 10 around its longitudinal axis. In the embodiment shown, the back roll 9 is located above supporting body 10 in the belt pressing unit, but any other arrangement could be used.

The circumferential length of the press belt 15 is selected so that there is a certain distance or spacing between press belt 15 and the outer surface of supporting body 10. In order that the press belt 15 can rotate quietly and without vibration even at high speeds, various guide ledges are arranged in the outer surface of supporting body 10. These guide ledges are distributed in the smallest possible number, for instance 4, around the outer surface of supporting body 10. At least one guide ledge may, if necessary, be radially displaceable, so that it can rest against the inner side of press belt 15 or be removed from it by radial displacement due to a small force. As a result, the press belt rotation will be more uniform and free of vibration.

The guide ledges described herein are the subject of copending U.S. application Ser. No. 592,629, filed of even date herewith, by Christian Schiel, Karl Steiner and Hans Flämig, and entitled "Belt Press Unit, Preferably a Wet Press of a Paper Machine". In the embodiment of FIG. 1, a total of four rigid guide ledges 22–25 are fastened into the supporting body 10, two in the central horizontal plane and two in the lower region. In the upper region, as close as possible to the press shoes 14*a* and 14*b*, are disposed two radially movable guide ledges 26 and 27. In order that guide ledges 26, 27 not participate in the deflection of the supporting body 10, they are supported on a rigid tubular beam 28 arranged within the hollow of the annular supporting body. Said beam 28 rests at its two ends in supports 29 in such a manner that it does not participate in the deflection or bending of supporting body 10 caused by the pressing force. On the beam 28 are ribs 30 against which stay bolts 70 rest. Stay bolts 70, which extend through the supporting body 10, in turn support the guide ledges 26 and 27. The guide ledges 26, 27 thus do not participate in the deflection or bending of the supporting body 10. They are thereby able to support the press belt 15 with a slight tensioning or application force, provided by springs or other means, which is uniform over their length, regardless of how much the supporting body 10 is deflected.

Tubular beam 28 also forms the object of the aforesaid copending U.S. application. Beam 28 may have a trough 45 mounted on it for the collection and discharge of the oil which has been removed from press belt 15, as discussed below, or it can be structured in its entirety as a duct or pipeline.

For cooling the press belt 15 and lubricating the slide surface of the press shoe 14 over which the press belt 15 travels, cold oil or other appropriate liquid is fed to press belt 15 from a source outside the supporting body 10 through a pressure line. In FIG. 1, two alternative means or main feed lines are shown for feeding the oil. A first pressure line 35 conducts the oil through a number of channels 36 into the region between the press shoe 14*b* and the guide ledge 27. A second pressure line 37 conducts the oil through a small number of channels 38 into the guide ledge 25 from which it passes to the inner side of the press belt 15 through a small number of holes 39. The two alternative feed means can be used together. In general, however, one of the two oil feed means described is sufficient for the main feed position. Compared with some prior art teachings, however, the cooling liquid in the invention need only be fed to press belt 15 at a very few feed positions. This saves liquid and saves the structural expense of additional feed lines or conduits.

Both pressure lines 36, 37 feed oil for cooling press belt 15 at a position near where the press belt emerges from the pressing zone around the press nip. In general, the main feed position is preferably arranged as close as possible to where the press belt 15 exits from the press zone. Any other desired arrangement of the main feed position within the first half of the periphery of the press belt 15 after the press zone is also possible, however. One factor which makes the invention effective is that the liquid fed onto press belt 15 travels together with press belt 15 over the greatest possible portion of the periphery of press belt 15 and thus takes up the largest possible amount of heat from it. Compared with some prior art teachings, this results in substantially better cooling and a considerable increase in the life of press belt 15, since a large part of the path of press belt 15 outside the press zone is used for the transfer of heat from press belt 15 to the cooling liquid. A second factor is that this layer of liquid which rotates with press belt 15 is substantially thicker than the layer of liquid serving for lubrication within the press zone, i.e. thicker than the layer of liquid which passes between press belt 15 and press shoe 14 through the press zone. Therefore, in accordance with the invention, a large part of the heat-absorbing layer of liquid is removed from press belt 15 before it enters the press zone. In other words, only a small part of the circulating layer of liquid is necessary for lubricating liquid in the press zone. This small part is sufficient to obtain the required lubricating effect.

In view of the high circumferential speed of press belt 15, the oil distributes itself as a uniformly thick layer over the inner side of press belt 15 and travels with the latter around supporting body 10. The guide ledges 22–27 can also contribute to making the thickness of the liquid layer of oil uniform, particularly in the direction transverse to the direction of travel of the belt. For this purpose, guide ledges 26 and 27, which are held free of deflection by resting on beam 28, are particularly suitable.

Several additional features are provided so that the rotation of the liquid layer of oil together with press belt 15 is decelerated as little as possible by the rubbing of guide ledges 22–27 against the press belt. In particular, the guide surface of each of the rigid guide ledges 22–25 is rounded or inclined toward the axis of rotation at the entrance side opposite the direction of travel of the belt, such as at rounded part 40 on guide ledge 24. Similarly, radially displaceable guide ledges 26 and 27 are rounded or inclined at their entrance sides, such as at rounded part 41 on guide ledge 26.

Figure 3:
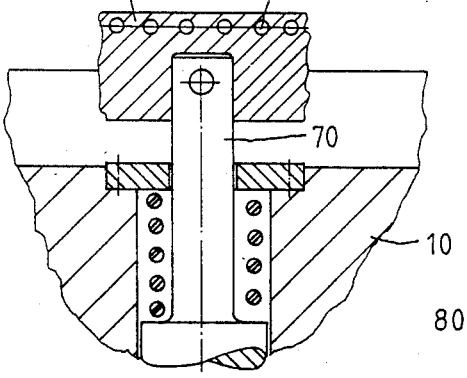
FIG. 3 is a partial sectional view along the line III—III of FIG. 1.
Figure 4:
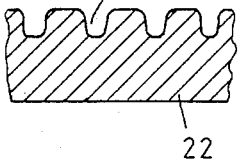
FIG. 4 is a partial sectional view along the line IV—IV of FIG. 1.

In order to prevent guide ledges 22–27, and especially guide ledge 27 immediately after main feed position, from scraping the layer of oil rotating with press belt 15, disturbing the heat transfer described above, additional features are provided. These features assure that a sufficiently large quantity of oil can pass by guide ledges 22–27 as press belt 15 rotates, despite the presence of the guide ledges. Specifically, passages or openings can be provided for the oil to pass through guide ledges 22–27, the openings extending in the direction of travel of the press belt. For example, bore holes 42, as shown in FIG. 3, or recesses 43, as shown in FIG. 4, can be provided in the guide surface of guide ledges 22–27.

After the cooling oil has traveled with press belt 15 over the largest possible distance, most of it is scraped off or removed by the press shoe in use at the time, such as central press shoe 14 in FIG. 1, before press belt 15 enters the press zone. Within the press zone, the cooling effect is not as important, since the time during which each point on press belt 15 passes through the press zone is extremely short, being only about one-twentieth or less of a full revolution, as shown in FIG. 1. If necessary, of course, at least part of the cooling liquid, after traveling with press belt 15, can also be conducted through cooling channels 65 in press shoe 14 in order to cool the pressing surface as discussed below in relation to FIG. 6. In this case, the cooling liquid is removed from around press belt 15 immediately after it exits from the press zone.

After being removed from the inner side of press belt 15 at each removal point, the oil is conducted into a discharge trough 45 through a number of channels 44 in the embodiment of FIG. 1. Press shoes **14*a* and 14*b* have corresponding channels 44*a* and 44*b* which are merely indicated by dot-dash lines in FIG. 1. The cross-sectional shape of the discharge trough 45 is selected so that it is operable to hold the oil even if supporting member 10 is rotated to bring one of the additional press shoes 14*a* or 14*b* into the active position. Instead of the trough 45 the tubular beam 28** could also be used as a discharge trough.

FIG. 2 shows the two-part discharge pipe 46 which adjoins the trough 45 and which has a telescopic connection **46*a* for permitting axial displacement of beam 28. The discharge pipe 46 discharges into an intermediate container 47 which is connected to a storage container 50 by a down pipe 48 with regulating valve 49. In container 50, cooling device 50*a* cools the oil by exchanging heat or by other appropriate means. A pump 51 pumps the oil through a pressure line 52 back to lines 35 and 37 shown in FIG. 1. The regulating valve 49 is controlled by a float 53, and possibly by a control device not shown in the drawing, so that a certain amount of oil is always retained in the intermediate container 47. As a result, air pressure produced within the belt-press unit for the inflation or stretching of press belt 15 is retained. In the storage container 50, which also serves to stabilize and degasify the oil, there are a plurality of flow guide baffles or walls 55 which ascend slightly in the direction of flow. These walls can be gable shaped in cross-section, to obtain a simple coalescing of bubbles of gas which rise upward and collect at the ends of the walls 55. The gas can then be removed from container 50**.

The speed of rotation of press belt 15 is generally so high that it carries the oil with it through the upward half of the rotation of press belt 15. Thus the oil may be removed from press belt 15 with the aid of gravity, particularly if the press zone is at the top of supporting body 10. Additional features shown in FIGS. 1, 7 and 8 can be used to remove the oil when the press zone is located in the lower region and when the belt is stopped or moving at a very slow speed.

Figure 7:
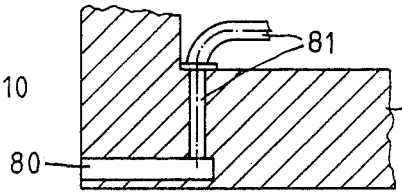
FIG. 7 is a partial cross-section along the line VII—VII of FIG. 1.

FIGS. 1 and 7 show an additional oil discharge line in the form of an axial suction opening 80 arranged on one end of supporting body 10 with a suction line 81 connected to it. In this arrangement, the oil first flows in an axial direction through opening 80, so that press belt 15 is not sucked against supporting body 10. If necessary, such suction lines can be provided at both ends of supporting body 10. When the level of oil in the lower part of press belt 15 reaches the top of suction opening 80, the oil may be sucked into supporting body 10 through suction line 81, as discussed below in relation to FIG. 8.

Figure 5:
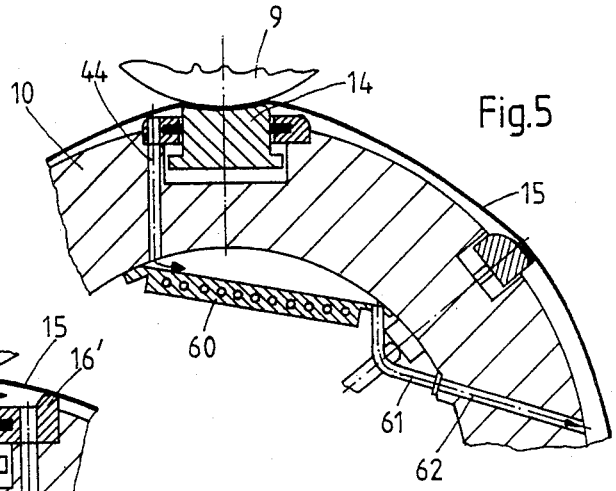
FIG. 5 is a partial cross-section view through a first alternative embodiment of the belt press unit of the invention.

The oil which has absorbed heat from press belt 15 need not be brought out of supporting body 10 for cooling. In the alternative embodiment shown in FIG. 5, a cooling plate 60, within supporting body 10, is cooled by a coolant passing through it. It is arranged in an inclined position in the upper region of the interior of supporting body 10 so that the liquid from the return channels 44 flows over its surface and is then fed solely by gravity through conduits 61 and channels 62 back to the inner side of press belt 15. This makes it unnecessary to remove gas from the oil, but requires that coolant be fed to the inside of supporting body 15.

Figure 6:
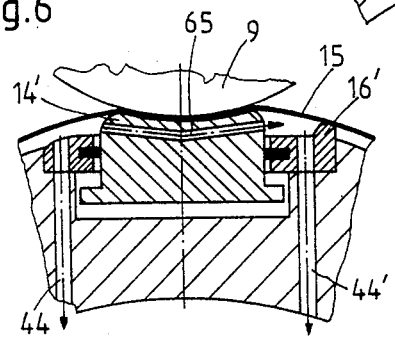
FIG. 6 is a partial cross-section view through a second alternative embodiment.

In the alternative embodiment shown in FIG. 6, press shoe 14' has cooling channels 65 near the pressing or slide surface for the press belt 15. The packing or seal carrier 16', on the side beyond press shoe 14' in the direction of travel of the belt, rests against press belt 15 and collects the oil emerging from the cooling channels 65. Return channels 44' then conduct the oil into the trough 45. In this embodiment, the cooling oil also cools the press shoe 14 after it has taken up heat from the press belt 15. Instead of return lines 44', as shown, other return lines could be connected directly to the cooling channels 65 and therefore to the press shoe 14' itself. This would prevent the heated oil from coming into contact with press belt 15 as it emerges from the cooling channels 65.

In FIG. 1, press belt 15 is shown in the position it has when at rest or at a low speed of rotation, but under a certain amount of internal air pressure. In this position it rests against ledges 26 and 27 and also lightly contacts the lateral ledges 22 and 25. At high speed, on the other hand, it travels over a substantially circular path, outside of the press zone, as a result of centrifugal force. In this position, the path of the revolving belt bends less at the upper ledges 26 and 27 than shown in FIG. 1. At the same time, the press belt may lightly contact the lower ledges 23 and 24.

Figure 8:
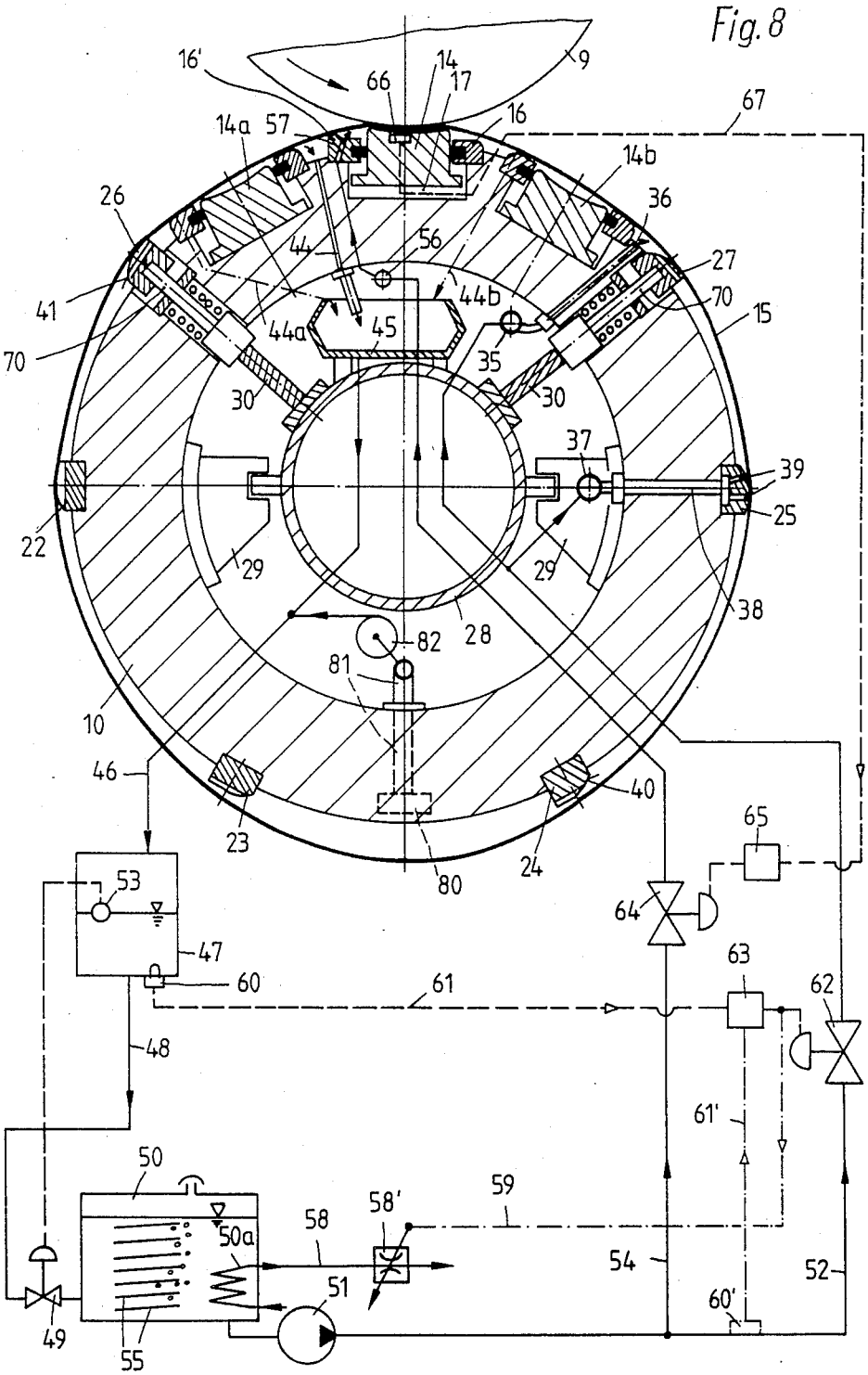
FIG. 8 is a cross-section similar to FIG. 1 with a schematic diagram of control devices for the liquid circuits.

FIG. 8 shows numerous details with the same reference numbers as in FIGS. 1 and 2. For example, FIG. 8 again shows pump 51, which pumps oils from the container 50 through delivery line 52 into the lines 35 and 37. In addition, a secondary delivery line 54 is connected to pump 51. Oil flows through line 54 into an additional line 56 and through several feed channels 57 through the packing or seal carrier 16'. The feed channels 57 are distributed along the side of press shoe 14 at which press belt 15 enters, which is a secondary feed position. In this way, the oil is divided into a cooling stream through lines 35 and 37 and a cooling and lubricating stream through lines 54 and 56.

FIG. 8 also shows control means for improving the cooling of press belt 15 and the cooling and lubricating of press shoe 14. In the two pressure lines 52 and 54 are regulating valves 62 and 64, respectively, controlled by signal converters 63 and 65, respectively. A temperature sensor 60 on intermediate container 47 feeds a variable signal to the signal converter 63 through a measurement line 61. This signal depends on the temperature of the oil which has flowed from the belt press unit into the intermediate container 47 after being removed from press belt 15. This signal is thus the guide value for the control of the regulating valve 62 which is moved further open when the temperature of the oil in the intermediate container 47 increases.

Alternatively, an additional signal from temperature measurement sensor 60' which depends on the temperature of the oil on the pressure side of pump 51 can be fed to the signal converter 63 via the line 61'. In this case, a guide value which corresponds to the difference between the oil temperature in the intermediate container 47 and the oil temperature on the delivery side of pump 51 is formed in the signal converter 63.

As a further alternative, the rate of the cooling action of cooling device **50*a* can be controlled by signal converter 63, which acts through control line 59 to control a throttle valve 58' installed in the coolant line 58**.

At least one temperature sensor 66 in the press shoe 14 near the convex slide surface is connected through a measurement line 67 to the signal converter 65. In this way, the amount of oil flowing through the lines 54, 56 and 57 can be automatically increased or decreased when the temperature in the press shoe 14 increases or decreases. The second signal converter 65, in addition or alternatively to controlling the regulating valve 64, may also act on the throttle valve 58' in the coolant line 58 by means not shown in the drawing.

Finally, FIG. 8 also shows suction pump 82 which can pump oil from the suction opening 80 and the suction line 81 shown in FIG. 7 through the line 46 into the intermediate container 47.

Although the present invention has been described in connection with a number of preferred embodiments thereof, many other variations and modifications will now become apparent to those skilled in the art. It is preferred, therefore, that the present invention be limited not by the specific disclosure herein, but only by the appended claims.

What is claimed is:

1. A method of guiding a stream of liquid through a belt press unit, comprising the steps of:

rotating a tubular elastic press belt around a supporting body in a direction of travel, the supporting body having an outer surface and the press belt being generally spaced apart from the outer surface of the supporting body as the press belt rotates; pressing the press belt against a web between a pressing surface inside the press belt and an opposing surface outside the press belt in a pressing zone; feeding a cooling stream of a liquid to the inner side of the tubular press belt at a main feed position near the pressing zone and downstream from the pressing zone when viewed in the direction of travel;

leaving the liquid on the inner side of the press belt for cooling the press belt as the press belt travels from the main feed position most of the way around the supporting body; and removing at least part of the liquid from the inner side of the press belt at a removal position near the pressing zone and upstream from the pressing zone when viewed in the direction of travel.

2. The method of claim 1 in which the liquid left on the inner side of the press belt is heated as the press belt is cooled, the method further comprising the steps of:

cooling the heated liquid that was removed from the inner side of the press belt; and returning the cooled liquid for feeding in the feeding step.

3. The method of claim 2, further comprising the step of:

inflating the press belt by inserting a gas under pressure into a closed inner space defined by the press belt;

the removing step comprising removing the liquid from the closed inner space while retaining the gas under pressure in the closed inner space; the step of cooling the liquid comprising feeding the heated liquid into a pressure-free container; the returning step comprising increasing pressure on the cooled liquid and feeding the cooled liquid under pressure into the closed inner space.

4. The method of claim 3, further comprising the step of:

degasifying the liquid in the pressure-free container.

5. The method of claim 2, further comprising the step of degasifying the liquid removed from the inner side of the press belt.

6. The method of claim 2 in which the step of cooling the heated liquid comprises flowing the heated liquid over a cooling surface.

7. The method of claim 1 in which the removing step comprises permitting a remaining nonremoved part of the liquid to enter the pressing zone, the method further comprising the step of:

lubricating the area of contact between the press belt and the pressing surface using a lubricating portion of the remaining part of the liquid.

8. The method of claim 7, further comprising the steps of:

cooling the pressing surface by passing a cooling portion of the remaining part of the liquid through at least one channel near the pressing surface; and collecting the cooling portion of the remaining part after it passes through the channel.

9. The method of claim 1, further comprising the steps of:

feeding a cooling and lubricating stream of the liquid to the inner side of the press belt at a second feed position nearer to where the press belt enters the pressing zone than the removal position; and cooling and lubricating the pressing surface and the press belt in the pressing zone using the cooling and lubricating stream of the liquid.

10. The method of claim 9, further comprising the steps of:

cooling the liquid removed from the inner side of the press belt;

sensing the temperatures of the pressing surface and of the liquid removed from the inner side of the press belt;

controlling the flow of the cooled liquid into the cooling stream and the cooling and lubricating stream according to the sensed temperatures; and returning the cooling stream and the cooling and lubricating stream of the liquid to be fed in the feeding steps.

11. A belt press unit comprising:

a supporting body having an outer surface;

a tubular elastic press belt around and movable around the outer surface of the supporting body, the press belt being generally spaced apart from the outer surface of the supporting body as the press belt moves around the supporting body;

a pressing means on the outer surface of the supporting body for pressing the press belt outward for pressing a web between the press belt and an opposing surface outside the press belt, the pressing means defining a pressing zone, the press belt moving around the supporting body in a direction of travel and moving with the web between the pressing means and the opposing surface;

feeding means for feeding liquid to the inner side of the press belt at a main feed position near the pressing zone and downstream from the pressing zone when viewed in the direction of travel;

means for permitting the liquid to remain on the inner side of the press belt for cooling the press belt as the press belt travels from the main feed position most of the way around the supporting body; and means for removing at least part of the liquid from the inner side of the press belt from at least one removal position near the pressing zone and upstream from the pressing zone when viewed in the direction of travel.

12. The belt press unit of claim 11 in which the supporting body has at least one channel defined therein, the feeding means comprising a first main feed line extending through the channel to the outer surface of the supporting body for feeding the liquid from inside the supporting body to the inner side of the press belt.

13. The belt press unit of claim 12 in which the supporting body has a first and second set of the channels defined therein, the feeding means comprises a first and second set of the main feed lines, the first feed line being part of the first set, the second set of main feed lines being disposed downstream in the direction of travel from the first set of main feed lines.

14. The belt press unit of claim 11 in which the press belt defines an inner space, the belt press unit further comprising:

rotating means connected to each end of the press belt for rotating as the press belt moves around the supporting body and for enclosing the inner space defined by the press belt; and means for inflating the press belt by inserting gas under pressure into the inner space.

15. The belt press unit of claim 14, further comprising:

means for receiving the liquid removed from the inner side of the press belt by the removing means;

means for maintaining the gas pressure in the enclosed inner space as the liquid is received by the receiving means; and means for removing gas from the liquid received by the receiving means.

16. The belt press unit of claim 15 in which the gas removing means comprises a container for receiving the liquid and a plurality of flow guide walls mounted in the container for coalescing bubbles of gas as the liquid flows through the container.

17. The belt press unit of claim 11, further comprising at least one guide ledge on the supporting body for supporting the press belt spaced apart from the outer surface of the supporting body, the guide ledge extending generally in a direction transverse to the direction of travel.

18. The belt press unit of claim 17 in which the guide ledge has a guide surface disposed toward the inner side of the press belt, the outer surface of the supporting body being centered about an axis, the guide surface having an entrance side disposed in a direction opposite the direction of travel and an exit side opposite the entrance side, the entrance side of the guide surface being nearer the axis than the exit side so that the guide surface is inclined.

19. The belt press unit of claim 18 in which the entrance side of the guide surface is rounded.

20. The belt press unit of claim 17 in which the permitting means comprise a plurality of passages defined in the guide ledge, the passages extending in the direction of travel for permitting the liquid to flow past the guide ledge.

21. The belt press unit of claim 11 in which the supporting body has an axial central opening and a receiving opening defined therein, the receiving opening extending from the lowest part of the axial central opening through the supporting body for carrying liquid from around the supporting body into the central opening, the belt press unit further comprising means for pumping liquid through the receiving opening into the central opening.

22. The belt press unit of claim 11, further comprising:

means for cooling the liquid removed from the inner side of the press belt; and means for returning the cooled liquid to the feeding means.

23. The belt press unit of claim 22 in which the cooling means comprises a cooling surface in the supporting body, the returning means comprising at least one channel extending from the cooling surface to the outer surface of the supporting body, the cooling surface and the channel being arranged for flowing the liquid across the cooling surface and through the channel solely under the influence of gravity.

24. The belt press unit of claim 22 in which the press belt defines an inner space, the belt press unit further comprising:

rotating means connected to each end of the press belt for rotating as the press belt moves around the supporting body and for enclosing the inner space defined by the press belt; and means for inflating the press belt by inserting gas under pressure into the inner space.

25. The belt press unit of claim 24, further comprising:

means for transferring the liquid removed from the inner side of the press belt out of the enclosed inner space and for maintaining the gas pressure in the inner space as the liquid is transferred; the cooling means comprising means for removing gas from the liquid; the returning means comprising a pump for exerting pressure on the cooled liquid for returning it to the feeding means.

26. The belt press unit of claim 11 in which the pressing means comprises a press shoe extending along the outer surface of the supporting body in a direction transverse to the direction of travel.

27. The belt press unit of claim 26 in which the press shoe has at least one channel defined therein extending generally in the direction of travel, the removing means removing liquid at a second removal position, the first one of the removal positions being near the pressing zone and upstream in the direction of travel therefrom, the second removal position being adjacent the pressing zone and downstream in the direction of travel therefrom.

28. The belt press unit of claim 11 in which the feeding means further comprises at least one secondary feed line for feeding the liquid to the inner side of the press belt at a secondary feed position adjacent the pressing zone and upstream in the direction of travel therefrom for cooling and lubricating the pressing means.

29. The belt press unit of claim 28, further comprising:

means for cooling the liquid removed from the inner side of the press belt; and means for returning the cooled liquid to the feeding means for feeding through the main feed line and the secondary feed line.

30. The belt press unit of claim 29, further comprising:

first control means for sensing at least one temperature of the liquid and for controlling the cooling of the press belt between the main feed position and the removal position according to the sensed liquid temperature.

31. The belt press unit of claim 30 in which the first control means comprises means for controlling the flow of the liquid through the main feed line according to the sensed liquid temperature.

32. The belt press unit of claim 30 in which the first control means comprises means for controlling the rate at which the cooling means cools the liquid according to the sensed liquid temperature.

33. The belt press unit of claim 30 in which the first control means comprises a sensor for providing a signal indicating the temperature of the liquid removed from the press belt, the first control means controlling press belt cooling according to the signal from the sensor.

34. The belt press unit of claim 30 in which the first control means comprises a first sensor for providing a first signal indicating the temperature of the liquid removed from the press belt and a second sensor for providing a second signal indicating the temperature of the cooled liquid, the first control means controlling press belt cooling according to the difference between the first and second signals.

35. The belt press unit of claim 29, further comprising:

second control means for sensing the temperature of the pressing means and for controlling the cooling of the pressing means by the liquid in response to the sensed pressing means temperature.

36. The belt press unit of claim 35 in which the second control means comprises means for controlling the flow of the liquid through the secondary feed line in response to the sensed pressing means temperature.

37. The belt press unit of claim 35 in which the second control means comprises means for controlling the rate at which the cooling means cools the liquid in response to the sensed pressing means temperature.

* * * * *